US009691370B1

(12) United States Patent
Stone et al.

(10) Patent No.: US 9,691,370 B1
(45) Date of Patent: Jun. 27, 2017

(54) ACOUSTICAL PANELS

(71) Applicant: Navy Island, Inc, West St. Paul, MN (US)

(72) Inventors: Jeffrey Stone, West St. Paul, MN (US); Chad Stone, West St. Paul, MN (US); Benjamin Stone, West St. Paul, MN (US)

(73) Assignee: Navy Island, Inc., West St. Paul, MN (US)

( * ) Notice: Subject to any disclaimer, the term of this patent is extended or adjusted under 35 U.S.C. 154(b) by 144 days.

(21) Appl. No.: 14/491,468

(22) Filed: Sep. 19, 2014

(51) Int. Cl.
*G10K 11/168* (2006.01)

(52) U.S. Cl.
CPC ..... *G10K 11/168* (2013.01)

(58) Field of Classification Search
CPC . G10K 111/172; B32B 3/12; E04B 2001/748; B64D 2033/0206
USPC ..... 181/292, 284, 290, 286; 52/144, 145
See application file for complete search history.

(56) References Cited

U.S. PATENT DOCUMENTS

| | | | | |
|---|---|---|---|---|
| 3,822,762 | A * | 7/1974 | Crispin | B64C 1/066 181/292 |
| 3,971,867 | A * | 7/1976 | Randall | 428/45 |
| 4,084,367 | A * | 4/1978 | Saylor et al. | 428/113 |
| 4,340,129 | A * | 7/1982 | Salyers | 181/200 |
| 6,182,787 | B1 * | 2/2001 | Kraft et al. | 181/292 |
| 6,220,388 | B1 * | 4/2001 | Sanborn | 181/290 |
| 7,520,369 | B2 * | 4/2009 | Dravet et al. | 181/292 |
| 7,549,505 | B1 * | 6/2009 | Kawar | 181/210 |
| 2005/0109557 | A1 * | 5/2005 | Dravet et al. | 181/292 |
| 2006/0118357 | A1 * | 6/2006 | Braun et al. | 181/290 |
| 2011/0076470 | A1 * | 3/2011 | Zaveri | 428/196 |
| 2013/0087408 | A1 | 4/2013 | Mader | |
| 2015/0068838 | A1 * | 3/2015 | Keene | 181/292 |

FOREIGN PATENT DOCUMENTS

| | | |
|---|---|---|
| WO | WO2006114090 | 11/2006 |

* cited by examiner

*Primary Examiner* — Forrest M Phillips
(74) *Attorney, Agent, or Firm* — Dicke, Billig & Czaja, PLLC

(57) ABSTRACT

Acoustical materials of the type provided in panel form for purposes of controlling or adjusting the acoustics of an interior space, such as an auditorium or concert hall, conference room, etc., and commonly referred to as architectural acoustical panels or ceiling panels. A panel comprises multiple layers, such as a surface layer which faces the room or sound source, which in turn comprises wood veneer laminated to a supporting layer and defines a plurality of microperforations extending entirely through, the surface layer. An acoustical absorbing layer may be a wood wool material or, most preferably, high-density fiberglass having a particular orientation, along with a combination of a support material or ribbing, which may define a plurality of cells in which the fiberglass lies. A back support layer may be perforated or solid. The density and orientation of the sound absorbing material combine with the density and quality of the microperforations to produce substantial improvement in sound absorption over a broad range of frequencies.

19 Claims, 19 Drawing Sheets

SC P-19 (E400 Mount)

SC P-19 (F6 Mount)

SC P-19 (E400 + 1")

SC P-19 (F6 + 1")

SC P-19 (E400 + 2")

SC P-19 (F6 + 2")

RF P-19 (E400 Mount)

RF P-19 (F6 Mount)

RF P-19 (E400 + 1")

RF P-19 (F6 +1")

RF P-19 (E400 + 2")

RF P-19 (F6 + 2")

RF P-25 (E400 Mount)

RF P-25 (F6 Mount)

RF P-25 (E400 + 1")

RF P-25 (F6 + 1")

RF P-25 (E400 + 2")

RF P-25 (F6 + 2")

RF M-19 (Direct Mount)

RF M-25 (Direct Mount)

ACOUSTICAL PANELS

TECHNICAL FIELD

This application pertains to acoustical panels which control or adjust the acoustics of an interior space, such as an auditorium or concert hall, conference room, etc. Such panels materials are often referred to as architectural acoustical panels or ceiling panels. They are often mounted onto interior structural walls, or suspended from ceilings, as opposed to being part of the building structure itself.

BACKGROUND

Acoustical panels are usually constructed of soft, pliable, porous materials, and visual aesthetics are secondary to sound absorption ability. Typically, the appearance of acoustic absorbers within architectural and public spaces is difficult to disguise, and so they are either displayed openly, such as acoustic ceiling panels or sprayed cellulose acoustical insulation, or concealed behind fabric.

SUMMARY

One embodiment is an acoustical panel for absorbing sound from a source. The panel has a surface layer defining within itself a plurality of microperforations characterized by average diameters in a range of 0.3 to 0.9 millimeter. The panel also has an acoustical absorbing layer, on an opposite side of the surface layer from the source of sound, comprising a combination of a support matrix defining a plurality of cells and fiberglass acoustical absorbing material of at least six pounds per cubic foot filling each cell. The fiberglass comprises individual sheets of fibers having fiber axes lying along a direction corresponding to panel thickness. A back layer of the panel is on an opposite side of the acoustical absorbing layer from the surface layer. The back layer may be solid or perforated. The surface layer may be a single material having inner and outer faces, or it may be a material which has a decorative wood veneer laminated to the outer surface of the substrate. The fiberglass has a density of less than 16 pounds per cubic foot, most preferably six to twelve pounds per square foot. Even more preferred is a panel in which the fiberglass has a density of 12 pounds per cubic foot and a thickness of about one inch.

DETAILED DESCRIPTION

In general, the acoustical panels of this invention exhibit high performance as absorbers when measured by standard testing techniques, e.g., a high noise reduction coefficient (NRC) value. This performance is believed to be due to a combination of the structural construction of the panels and the selection of materials for the construction.

Figure 1:
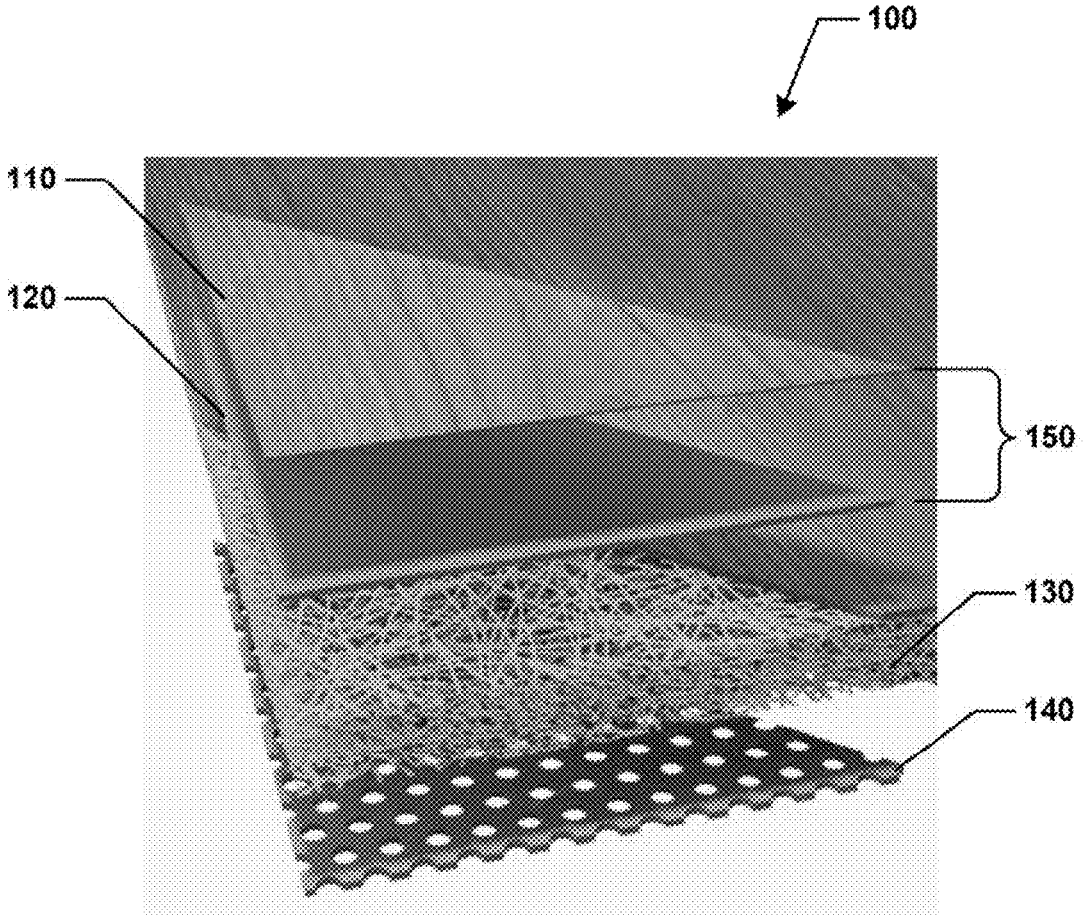
FIGS. 1-3 are each a partially exploded, perspective cross-section of embodiments of the invention.
Figure 2:
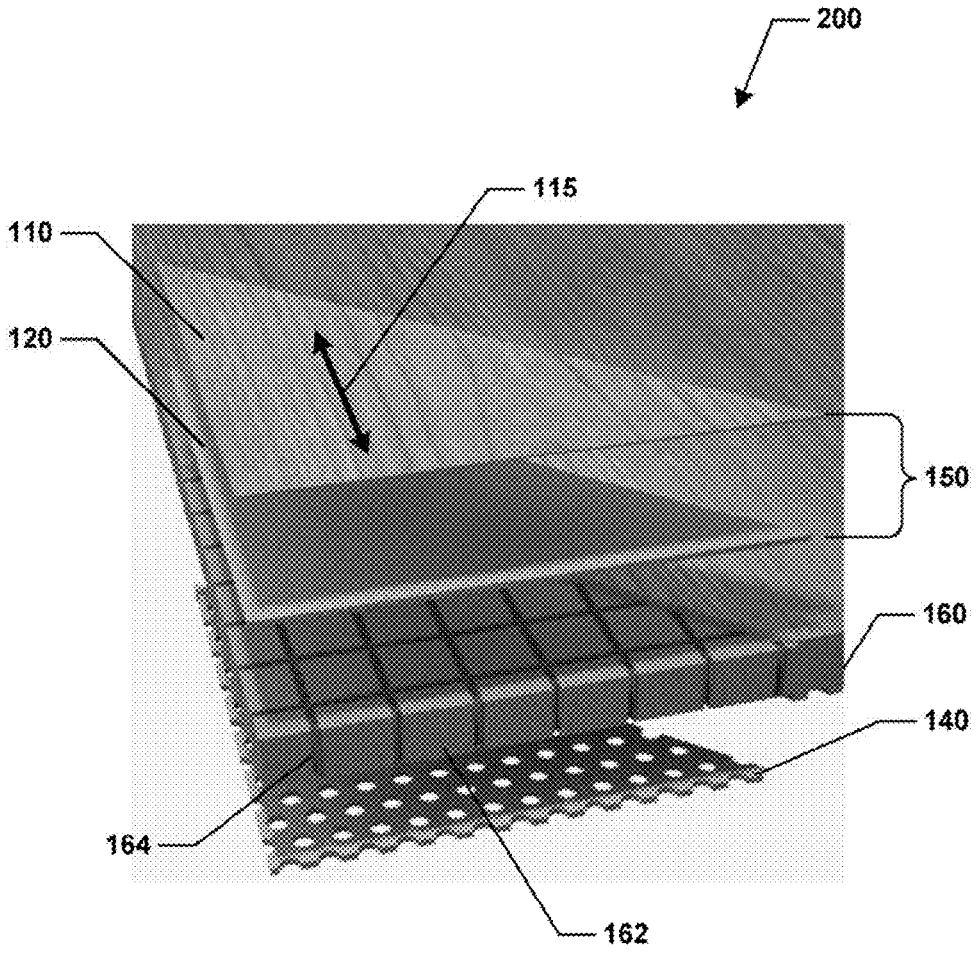
Figure 3:
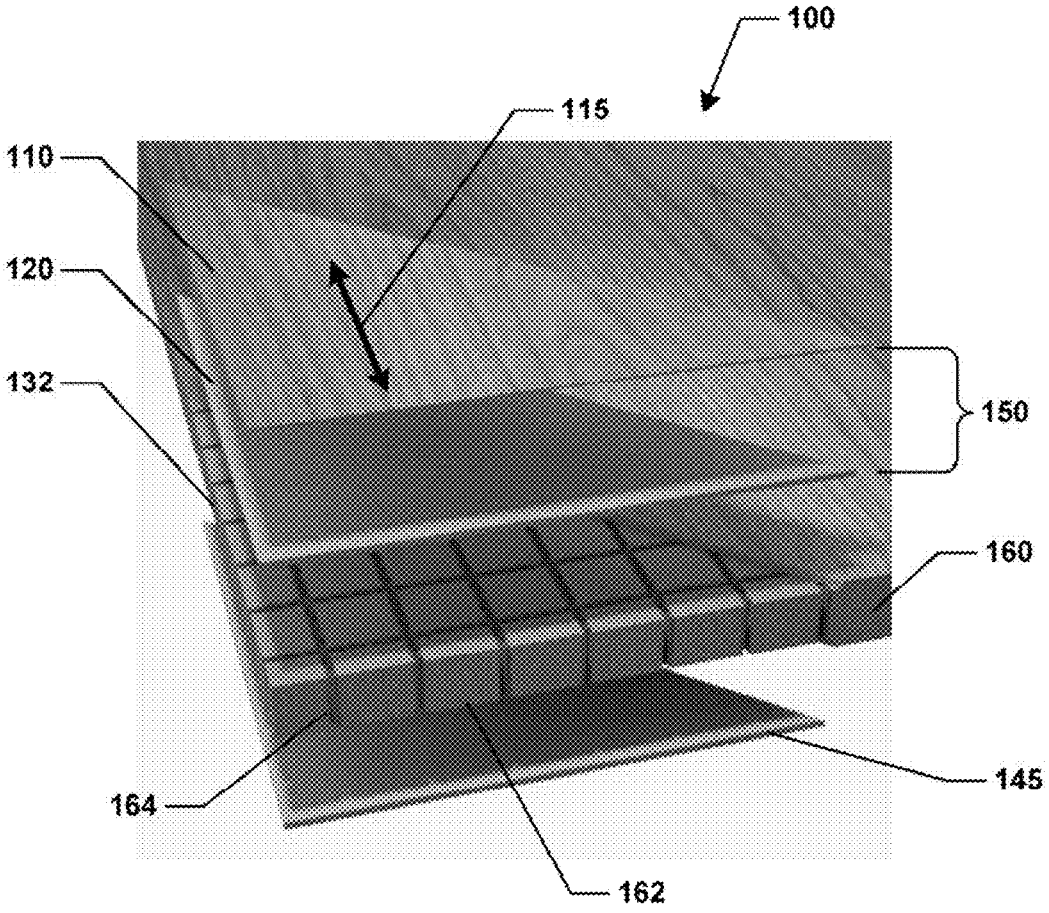

FIGS. 1-3 are preferred embodiments of acoustical panels for absorbing sound from a source (not shown). Each embodiment comprises a surface layer, visible from the room (or, more generally, the source of the sound), which the sound strikes and penetrates as described in more detail below. Beneath the surface layer lies an intermediate acoustical absorbing layer, in which most of the sound energy is absorbed. Finally, a backing or base layer supports the absorbing layer and enables the panel as a whole to be mounted to a wall or ceiling.

For example, and referring specifically to FIG. 1, in this embodiment panel 100 has a surface layer 150 which comprises decorative wood veneer 110 laminated to an outer surface of substrate 120. In order for the decorative surface of wood veneer 110 to be effective as an acoustical panel, it must be laminated to a substrate 120 for support. The substrate must allow sound to pass through itself, while providing a structural base to support the hard face of veneer 110 as well as have the ability to support an edge of a similar surface as the face of the panel 100. The inner surface of substrate 120 faces the acoustical absorbing layer 130. Panel 100 further comprises a back layer 140 which is illustrated as being perforated although in general back layer 140 could be solid. Once assembled, the panel 100 can be applied to a wall or used as a self supporting ceiling tile. Typically the combined thickness of this panel is between ¾" and 4" thick.

Figure 4:
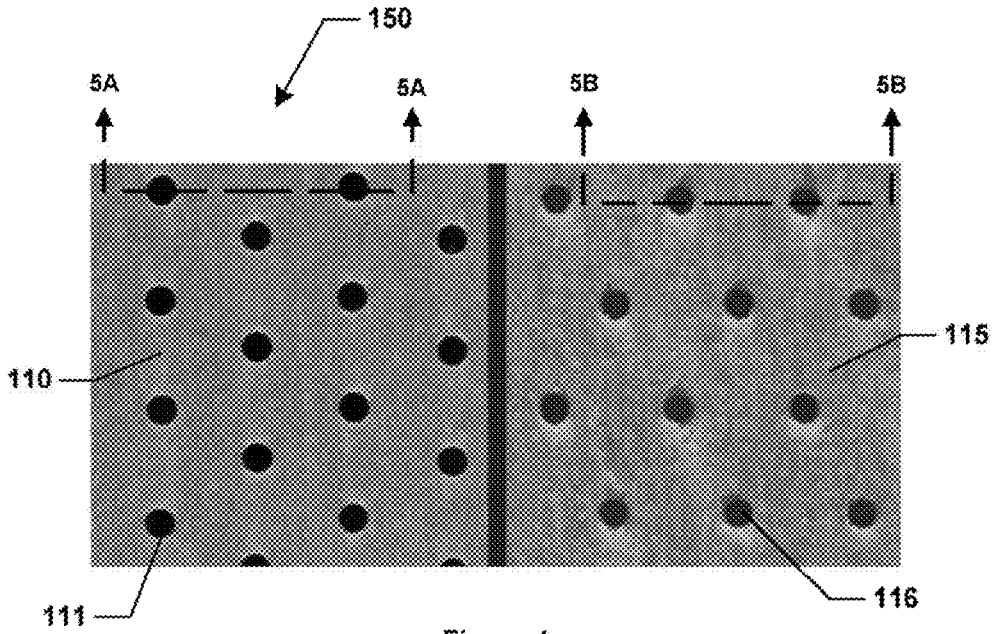
FIG. 4 is a schematic illustration of a comparison of the quality of microperforations which are preferred (left) and not preferred (right) in use of the invention.

Turning briefly to FIG. 4, the left side of that figure shows that surface layer 150 is microperforated with a plurality of cylindrical perforations 111 (not visible in FIG. 1) characterized by average diameters in a range of 0.3 mm to 0.9 mm. The number of such microperforations ranges from about 100,000 to 325,000 per square meter (or about 10,000 to 30,000 per square foot). An alternative description is that, independent of the very large number of microperforations per unit area or their average diameters, only about 2% to 8% of the total surface is perforated, with 6% being a typical value.

Such microperforations are known to have acoustical behavior dependent on sound intensity or volume. At low intensity levels, the acoustic energy is below a critical threshold to propagate evacuation and resonance of air through the microperforations. This threshold is determined by several variables including the size, pattern, spacing, depth and shape of the micro perforation, but is usually under 50 decibels. At medium sound intensity levels (50-80 decibels), sufficient energy exists to sustain air resonance within the microperforations. In this volume range, primary sound absorption occurs from acoustical energy losses through thermal and viscous friction. At high sound levels (over 80 decibels), an additional effect, called jetting, becomes the dominate method of energy absorption. Air molecules are unorganized when they enter a micro-perforation, but as they flow through the perforation, the friction between the air and the perforation's walls organize the molecules into donut-shaped rotating vortices. Due to the high level of acoustic energy contained in the vortices, they continue rotating upon exiting the perforation, and can travel a significant distance into subsequent acoustical absorbing media on the opposite side of the microperforations from the source of sound, as discussed further below.

Figure 5B:
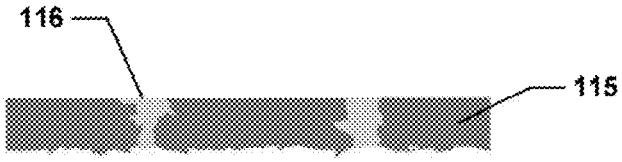
FIGS. 5A and 5B are cross-sectional views taken along the lines 5A-5A and 5B-5B of FIG. 4.
Figure 5A:
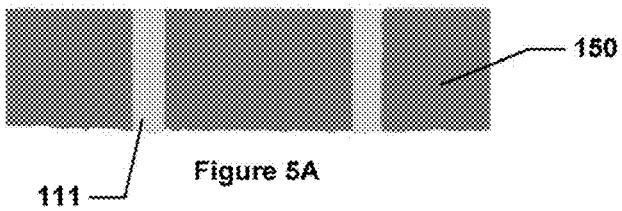

In addition, the quality of the microperforations 111 as compared to the conventional microperforations 116 in a comparative prior art surface layer 115 contributes to the acoustical performance of the completed panel. In general, microperforations must be substantially cylindrical, i.e., the sides must be as smooth as possible and the edges where the perforations join with the upper and lower surfaces of the material in which they are formed should be as sharp as possible. This is illustrated in FIGS. 5A and 5B, which compare the quality of microperforations 111 shown in FIG. 5A below FIG. 5B, which shows microperforations 116. The higher quality microperforations 111 of FIG. 5A have uniformly parallel sides (in the cross-sectional view), as shown in FIG. 5A. The diameters of such high-quality microperforations 111 do not vary with depth into the material to any significant degree, again as shown in FIG. 5A in comparison to the diameters of the perforations 116 shown in FIG. 5B. Also, high-quality microperforations 111 have sharp, ideally perpendicular, rims at their upper and lower ends, i.e., the surfaces of the material in which they are formed. Referring briefly again to FIG. 4, note the lack of indentation surrounding the edges of microperforations 111 as compared to the visible ring-shaped indentations surrounding the edges of holes 116. Thus, the quality of the microperforations may be measured by determining the surface diameter, i.e., the diameter of the portion of the surface that is indented to any degree, and the passage diameter, .e.g, the (average or ideally constant) diameter of the same microperforations at locations within the thickness of the material. High quality microperforations will have the lack of indentations noted above, and thus surface diameters which do not substantially exceed their passage diameters, and which in the ideal case are the same value.

There are several known processes by which microperforations may be formed, including conventional drilling, laser engraving, pin-punching, and water jetting (which his possible in materials in which moisture absorption is not an issue, although water jetting does produce microperforations having undesirable tapered edges). Conventional drilling has the disadvantage of requiring a significant amount of tooling cost and time on a CNC machine, which adds significant cost to the panel. Laser engraving also requires significant amounts of machine time and also often (particularly on light-colored veneers) creates burn rings or other marks that are unacceptable in an architectural situation. Pin-punching produces the low quality holes illustrated in the right side of FIG. 4 and FIG. 5B.

Returning to FIG. 1, to maximize the amount of sound passing through substrate 120, it must be porous, which is typically accomplished by using a drilled-out wood-based medium density fiberboard (MDF) or a wood-based particle board (PB). Of course, the more holes that are drilled into the MDF/PB material, the weaker the substrate becomes; excessive removal of the substrate material adversely affects the structural integrity of the entire panel. For typical acoustical panels, up to 50% of the MDF/PB can be removed before the structural integrity is compromised. Other alternatives to MDF/PB include: honeycomb, chipboard, fiberglass (the preferred material), and foam.

Continuing with FIG. 1, acoustical absorbing layer 130, which in this embodiment is illustrated as a material known as wood wool, is positioned on an opposite side of the surface layer 150 from the source of sound (not shown), and thus lies inside acoustical panel 100. This material, also known as cementitious wood fiber (commercially available under the tradename TECTUM), has a core which consists of long strands of a wood fiber mixed with a cement-type adhesive. It is rigid and has a very low density presenting substantial open area in which sound may be absorbed. However, it is also very brittle and it can be difficult to apply a rigid surface to it without crushing it in the process of compressing the rigid surface sheet to create the bond. Fortunately, the use of expandable adhesives enables suitable bonds to be created. Embodiments using this material as the acoustic layer are preferred for ceiling applications.

Acoustical panel 100 is completed by a third major layer, namely a back layer 140 which lies on an opposite side of the acoustical absorbing layer 130 from the surface layer 150. In general, the back layer 140 may be perforated (as specifically illustrated in FIG. 1) or solid.

FIGS. 2 and 3 are alternative embodiments which share many components as the embodiment of FIG. 1. In FIG. 2, acoustical panel 200 has a surface layer 150 and a back layer 140 which are essentially the same as their counterparts in FIG. 1. In FIG. 3, back layer 145 is solid as opposed to perforated back layer 140 of FIGS. 1 and 2.

The embodiments of FIGS. 2 and 3 each have an acoustical absorbing layer 160 in the form of cells of acoustical absorbing material 162. As illustrated, the acoustical absorbing material 162 in FIGS. 2 and 3 lies in a plurality of cells or strips formed by a support matrix 164.

A preferred acoustic absorbing material 162 is high-density fiberglass, having a density of six pounds per cubic foot or greater. In some embodiments, the density is preferably in the range of eight to 16 pounds per cubic foot, more preferably in the range of ten to fourteen pounds per cubic foot, and most preferably twelve pounds per cubic foot.

At low densities, i.e., six pounds per square foot or less, if the depth of the fiberglass is not increased, an increase in density of the fiberglass leads to an increase in noise reduction. Prior to the development of the embodiments disclosed in this application, it was known that increasing fiberglass density above six pounds per cubic foot would not improve acoustic performance. This is because the denser materials would actually reflect sound instead of absorbing it. Thus, in conventional panels which employed fiberglass, lower densities of fiberglass were preferred, especially in thicker panels, to prevent sound reflection.

Despite this knowledge, however, higher density fiberglass is preferred in the embodiments described here, provided it is oriented as described below, because of the increase in impact resistance of the finished panel due to the non-acoustic bulk property of the material. Surprisingly, provided it is properly oriented, the noise reduction coefficient (NRC) of panels according to the embodiments of FIGS. 2 and 3 is increased by use of a higher density fiberglass material. According to these embodiments, the fiberglass is arranged so that the fiber axis lies along the panel thickness direction, i.e., the individual "sheets" of fiberglass 162*a* run between the inside surfaces of the surface layer 150 and back layer 140 (or 145), as illustrated in the inset portion of FIG. 6 (which is a partial cross-sectional view of the embodiment of FIG. 3). This orientation is perpendicular to the direction commonly used in acoustic panels. Arranging the fiberglass in this way allows sound to penetrate between the individual sheets 162*a* and thus more deeply into the thickness of the material 162, as opposed to being reflected by the surface of the topmost fiberglass sheet if the batt were oriented with the sheets 162*a* parallel to the face of the panel. Such orientation does, typically, increase the labor cost of assembling a panel by approximately 10%, but the improvement in acoustical performance is substantial, on the order of 20% as measured by NRC value, particularly in the range of 70 to 110 decibels (dB).

Figure 6:
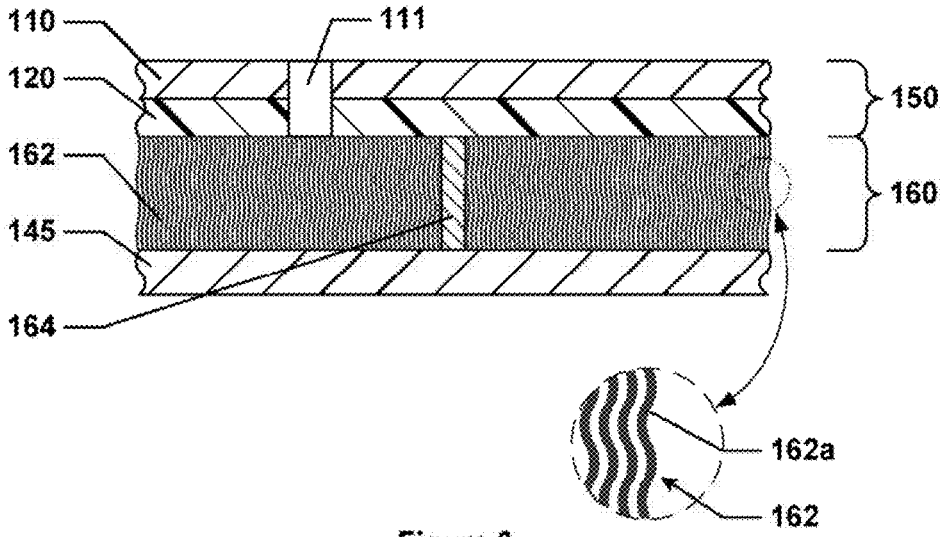
FIG. 6 is a schematic partial cross-sectional view of the embodiment of FIG. 3, including an enlarged inset view of a portion of the Figure.

In the panels manufactured according to the preferred embodiment of FIG. 6, the fiberglass thickness remains constant and the "width" of the sections of fiberglass is increased. Although the total mass or volume of fiberglass is the same in both methods, the acoustical performance is not. (This assumes no change in the composition of the support matrix; as discussed below, that component can additionally and independently contribute to improved acoustic performance of a pane.)

Support matrix 164 performs the important function of giving the entire panel 100 rigidity and strength, thus ensuring that the front layer 150 and back layer 140 (or 145) remain strongly assembled to each other. This property which is sometimes known as "tie-back (i.e., the ability to successfully "tie" the front and back surfaces of the panel together), is required to prevent the finished panel from delaminating (the greatest concern), warping or otherwise being unable to span the relatively large distances required of architectural installations (i.e., on the order of eight to fourteen feet). Because the panels are so large and visible to building occupants, even very small amounts of warping or "honeycombing" are visible across the surface of a large panel, which is unacceptable.

To accomplish this, a typical construction involves adhering the inside face of each such layer to the edge surfaces of support matrix 164 with a compatible adhesive. In the embodiment illustrated, matrix 164 is formed from corrugated fiberboard, specifically a single wall construction arranged so that the flutes run along the major dimensions of the finished panel, i.e., what will become the height and width of the panel (as opposed to the panel thickness measured between the outermost surfaces of the surface layer and back layer). Thus, the facings (the flat, parallel members of the corrugated fiberboard) form the walls or ribs of the cells in which the absorbing material 162 lies.

Figure 7:
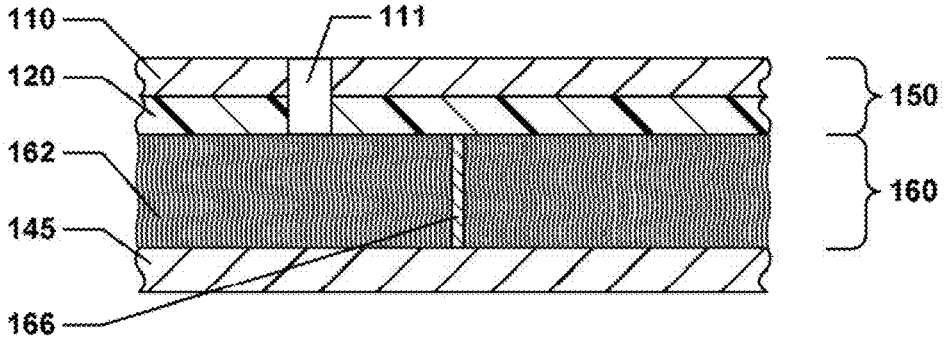
FIG. 7 is a schematic partial cross-sectional view of an alternative embodiment like that of FIG. 6, but employing a preferred support matrix material.

As illustrated in FIG. 7, a preferred alternative to the corrugated fiberboard material for support matrix 164 of FIG. 6 is a relatively inflexible fiberglass sheet material 166, in the form of stacked layers of vertically oriented long strand resin-bonded fiberglass mesh having thickness of 0.25 to 1.0 mm, most preferably about 0.5 mm. There are several advantages to this material. First, it contributes significantly to enabling the panel as a whole to have acceptable fire ratings. Second, it is exceptionally strong and provides a substantial degree of tie-back for its weight. Third, as suggested by FIG. 7 in comparison to FIG. 6, it provides similar or improved performance in a thinner material, which in turn increases the size of the volume of cells which may be devoted to acoustical absorption. This in turn increases the performance of a panel of otherwise identical size and construction. Yet another improvement in acoustic performance comes from the mesh being itself made of fiberglass, which is more acoustically absorbent than cardboard (and substantially less combustible, thus contributing to the improved fire rating of a finished panel). Finally, as compared to the cardboard in which different materials (cardboard and fiberglass) being used in the same layer would expand and contract at their naturally different rates, no "telegraphing" of the ribs or "honeycombing" is observed.

Another alternative material for the support matrix, but which is not preferred, is corrugated aluminum. Aluminum contributes to the fire resistance of the assembled panel but has the disadvantage of not supporting adhesive bonding (that is, preventing de-lamination of the finished panel) as well as other materials. Yet another material is non-woven, flash-spun high-density polyethylene fibers known commercially as TYVEK.

As illustrated in the FIGS. 2 and 3, the cells are square, but this is optional. Typical cell size is between one half and one inch. In general, smaller values are preferred as it is less likely that the underlying grid will be "telegraphed" to the visible front surface of the panel by way of slight variations in panel smoothness. Of course, this comes at a cost of increased amounts of material and thus total panel cost.

Also as illustrated in FIGS. 2 and 3, a two-dimensional support matrix 164 is illustrated, but this is only a preference. One dimensional structures are possible. Similarly, the major direction(s) of the support matrix 164 are illustrated as arranged parallel/perpendicular to the major finished panel directions, one of which typically aligns with the grain direction 115 of wood veneer 110. Other orientations are suitable (e.g., a forty-five degree angle to grain direction 115). However, depending on the dimensions of the finished panel 100, there may be difficulty assembling the edge material to the finished panel, especially if (as is common), there is little contact surface available for an adhesive to strongly bond the materials together. In this regard, the higher density fiberglass (e.g., the twelve pound per cubic foot material mentioned above) is dense enough that diagonal layout is not necessary; even the faces of the layer which show the edges of the material are sufficiently dense for edge banding to be successful with conventional adhesives.

While the Figures illustrate the components of the acoustic panels without edges, a commercially viable acoustic panel may require edge treatment or banding along (typically) all four of its edges. Low density fiberglass (e.g., six pound per cubic foot fiberglass) does not support a decorative edge well, but a frame comprising a hardwood or fiberboard can be constructed around the perimeter of the fiberglass and then the decorative face can be subsequently applied, but this is a costly process. The higher density fiberglass materials preferred in some embodiments disclosed here may support a decorative edge without such frames.

Example

Acoustical panels exemplifying the principles of the various embodiments described above may be constructed as follows. First, a subassembly is made by adhering veneer or laminate (typically wood, but it could be vinyl, paint, laminate, or metal foil) in a thickness range of 0.020 to 0.100 inches (0.075 inches being a typical value), to a suitable fiberboard, PVC, or phenolic backer board (thickness in the range of 0.050 to 0.060 inches, using conventional adhesives (such as commercially available polyvinylacetate [PVA] or urea formaldehyde compositions). A preferred material is high density (HD) fiberboard. These two plies are applied to a third ply, a substrate which may be Owens Corning "Rigid Fiberglass Board" number 705, Knauf "Acoustical Smooth Board," or Johns Manville "Whispertone." The plies are laminated together by adhesives. Depending on the exact adhesive selected, it will typically be applied in thicknesses of one to five thousandths of an inch, at temperatures ranging from room temperature to 250° F. (typically about 200° F.), and subjected to pressures in the range of 20 to 150 psi (typically about 89-90 psi) for durations ranging from as little at 40 seconds to as long as 24 hours to ensure complete curing.

Next, this subassembly is perforated in the desired pattern (i.e., number, location, and size of perforations) by a suitable known process (e.g., pins, lasers, drilling, or water-jetting).

It has been found that the microperforations allow moisture from the ambient air to penetrate finished panels, such that contraction and expansion of the finished panels in normal use may exceed desirable amounts. This problem is more pronounced in larger panels than in smaller panels. A preferred approach to address this is application of an optional layer of 0.050 inch thick phenolic-impregnated paper or PVC on the back (inside) face of the subassembly prior to perforation.

Separately, a fiberglass reinforced sheet is adhered to acoustical fiberglass using an adhesive. A preferred sheet is a nonwoven web composed of glass fibers oriented in a random pattern and bonded together with a cross-linked acrylic resin system in a wet laid process, for example, a 0.58 mm thick mat known commercially as DURA-GLASS® brand mat, model number 8514 available from Johns Manville Engineer Products America of Denver, Colo. Suitable adhesives include polyvinylacetates (PVAs), urea formaldehydes, urea melamines, and contact adhesives, as are commonly used in similar applications. Additional layers of reinforced fiberglass sheet and acoustical fiberglass are added in alternative layers to form a "bunk" of increased thickness.

The bunk is cut into strips of suitable size, which are laid out on edge such that the fiberglass mat forms the ribs (or "ribbing") alternatively with the acoustical fiberglass, thus forming a substrate in which the direction of the fiberglass layers is reoriented into the proper plane.

The perforated two-ply sheet is then applied to the reoriented fiberglass substrate and adhered in place. This "one-sided" assembly is then calibrated to a uniform thickness, and a backer sheet is applied to the face opposite from the perforated two-ply sheet to form a rigid panel. The rigid panel may then be cut or trimmed to final size and any excess overhanging material is removed from all surfaces.

Various panels having a variety of materials according to the general process described above are summarized in the following Table 1. In Table, 1, when referring to microperforations, the "surface diameter" and "passage diameter" measurements refer to measurements taken at the panel surface and within the panel thickness, respectively. The equality of these two values indicates the high quality of the microperforations employed in these panels. Also, the term "offset" refers to a pattern in which the microperforations in adjacent rows (or columns) are offset by one-half the spacing between holes. An example of this pattern is illustrated in FIG. 4.

Acoustical performance (noise reduction coefficient, or NRC) values and figure numbers corresponding to the same are listed in Table 2. For example, for the panel identified as RF M-1P, acoustical performance was determined by mounting samples of materials as indicated and performing the test specified in ASTM C 423-09a ("Sound Absorption and Sound Absorption Coefficient by the Reverberation Room Method"). The NRC was calculated by rounding the sound absorption coefficients for the 250, 500, 1000, and 2000 Hz bands to the nearest 0.05. Sound Absorption Average (SAA) was calculated by rounding the sound absorption coefficients for the twelve frequencies from 200 Hz to 2500 Hz to the nearest 0.01. Test equipment included a ½" pressure condenser microphone (GRAS model 40AD) located in the reverberation chamber, a microphone calibrator (Norsonic model 1251), a data acquisition module (National Instruments model N19234) located in the control center, and a temperature/humidity transmitter (Dwyer Instruments series RH) located in the reverberation chamber. Typical conditions were 21.4 Celsius, 42% relative humidity, and ambient atmospheric pressure of 968 hPa (hectopascal; 1 hPa ≡100 Pa, which is equal to 1 millibar).

The figures identified in Table 2 are graphs of the acoustic performance (absorption coefficient as a function of frequency) for the various embodiments, mounted according to industry standard techniques (e.g., E400 or F6), or in some cases directly mounted to a wall. In the case of E400 and F6 mounts, where indicated, additional absorbing material at thicknesses of 1 inch or 2 inch may be located behind the panel. It should be noted that in some cases, measurement and/or calculation error appear to result in a negative NRC value, which is not possible; these measurements are best understood as being values of zero. Examples of such cases are RFP-19 with F6 Mount (FIG. 15) at 125 Hz, and RFP-19 with F6 Mount and 1 inch of additional absorbing material (FIG. 17) at 80 Hz.

All panels in the following tables may have a face layer selected from wood veneer, vinyl, high pressure laminate, or paint. All panels may be assembled to a maximum size of 1549 mm×3683 mm (61 inch×145 inch).

The results demonstrate superior acoustical performance which may be characterized in any of several ways. For example, many of the results show an absorption coefficient of 0.5 or greater over very broad frequency ranges. Examples include FIGS. 8 and 10-13 (among others) having absorption coefficients of 0.5 or greater over the 200-5000 Hz range; and FIGS. 10-13 and 15, 17, 19, 23, and 25 having absorption coefficients of 1.0 or greater over multiple frequency bands.

TABLE 1

| | Properties | | | | |
|---|---|---|---|---|---|
| | Designation | | | | |
| Property | SC P-19 | RF P-19 | RF P-25 | RF M-19 | RF M-25 |
| Core | Monolithic Wood Wool | Sintered Resin-Reinforced Glass Wool | Sintered Resin-Reinforced Glass Wool | Sintered Resin-Reinforced Glass Wool | Sintered Resin-Reinforced Glass Wool |
| Thickness | 19-44 mm | 19-51 mm | 25-51 mm | 19 mm | 25-51 mm |
| Weight | 6.73 kg/m$^2$ @ 19 mm thick | 5.62 kg/m$^2$ @ 19 mm thick | 8.1 kg/m$^2$ @ 25 mm thick | 5.86 kg/m$^2$ @ 19 mm thick | 8.3 kg/m$^2$ @ 25 mm thick |
| Microperforations | | | | | |
| Surface Diameter | 0.5 mm | 0.5 mm | 0.5 mm | 0.5 mm | 0.5 mm |
| Passage Diameter | 0.5 mm | 0.5 mm | 0.5 mm | 0.5 mm | 0.5 mm |
| Passage Depth | 1.7 mm | 1.7 mm | 1.7 mm | 1.7 mm | 1.7 mm |
| Pattern | Offset | Offset | Offset | Offset | Offset |
| Fire Rating (ASTM E84) | Class A | Class A | Class A | Class A | Class A |

TABLE 2

Figure 8:
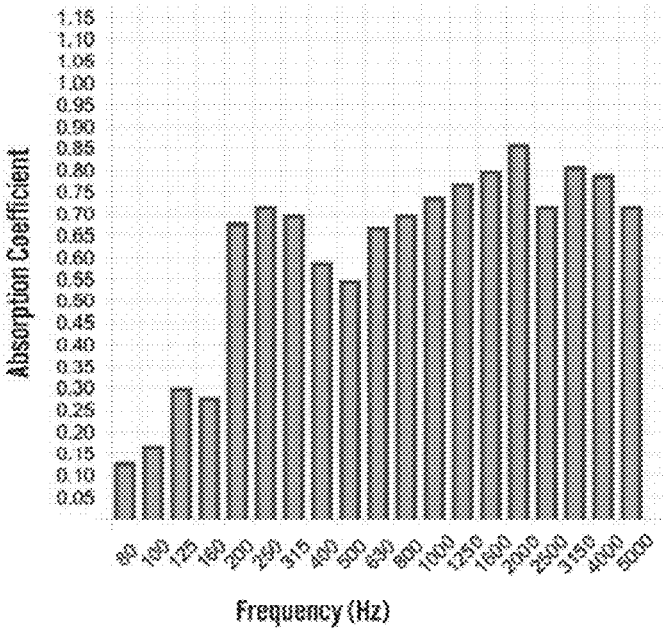
FIGS. 8-27 are graphs of absorption coefficient values as a function of frequency (in Hertz) for various embodiments, as identified in more detail in Table 2, below.
Figure 9:
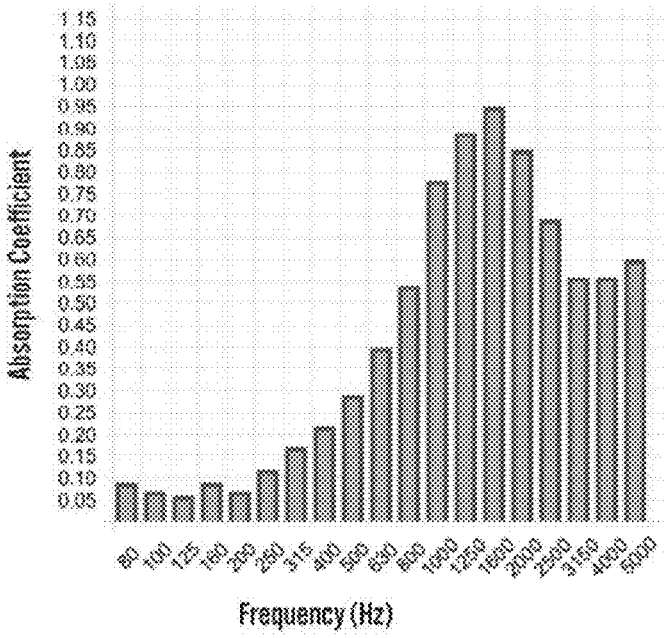
Figure 10:
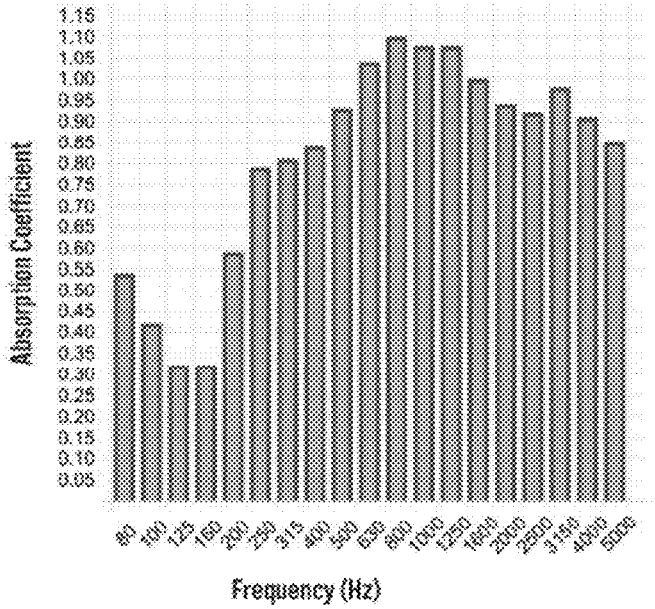
Figure 11:
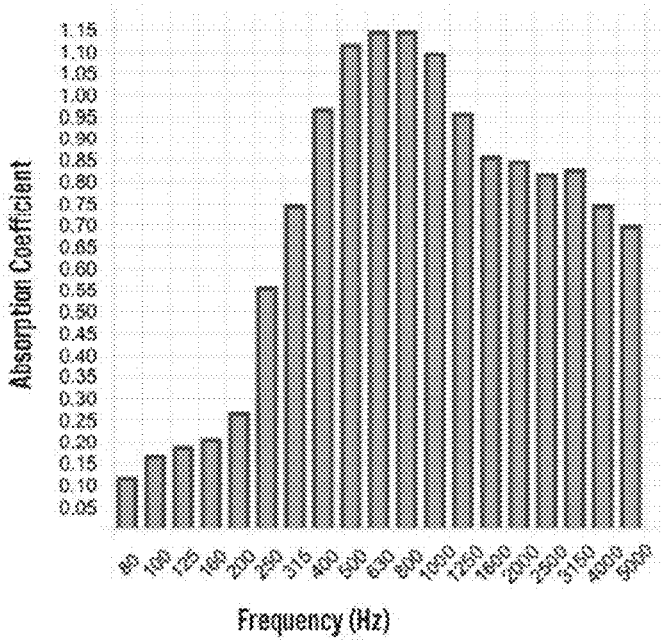
Figure 12:
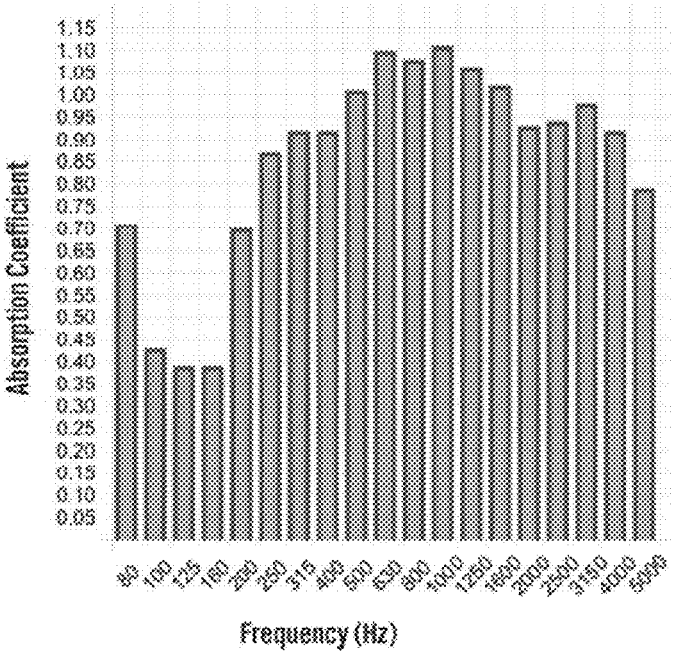
Figure 13:
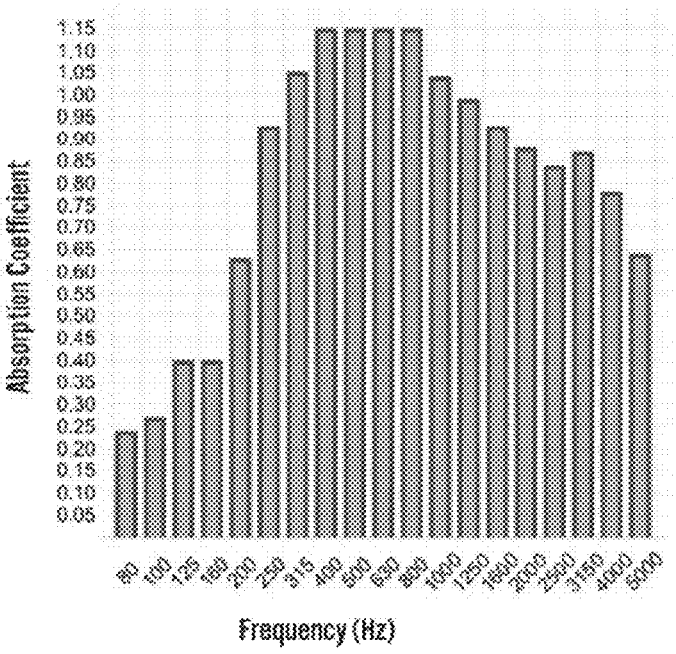
Figure 14:
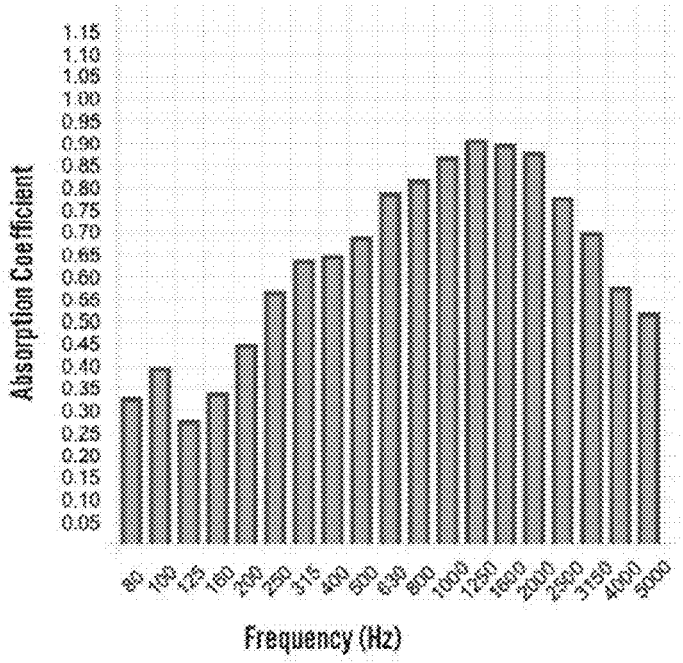
Figure 15:
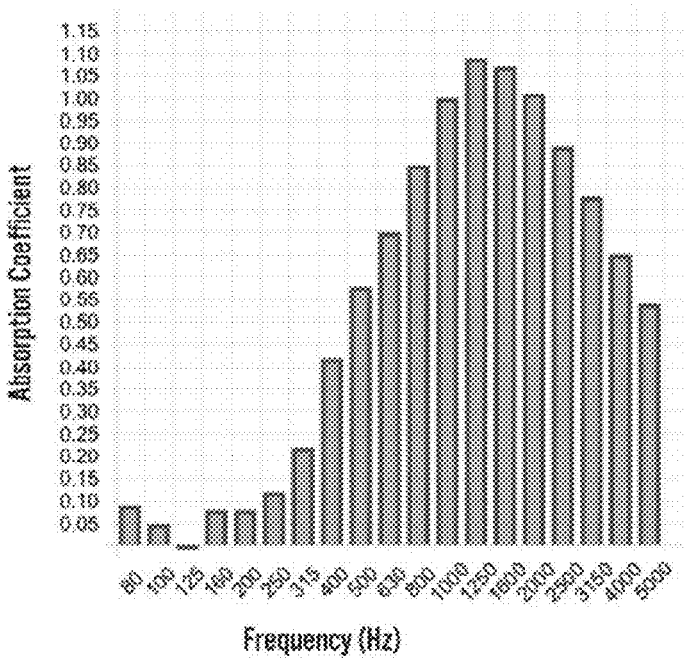
Figure 16:
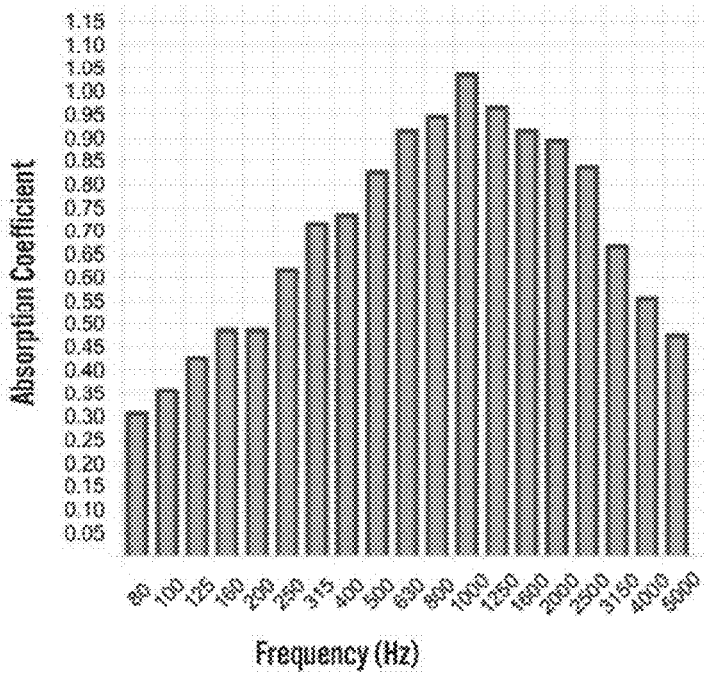
Figure 17:
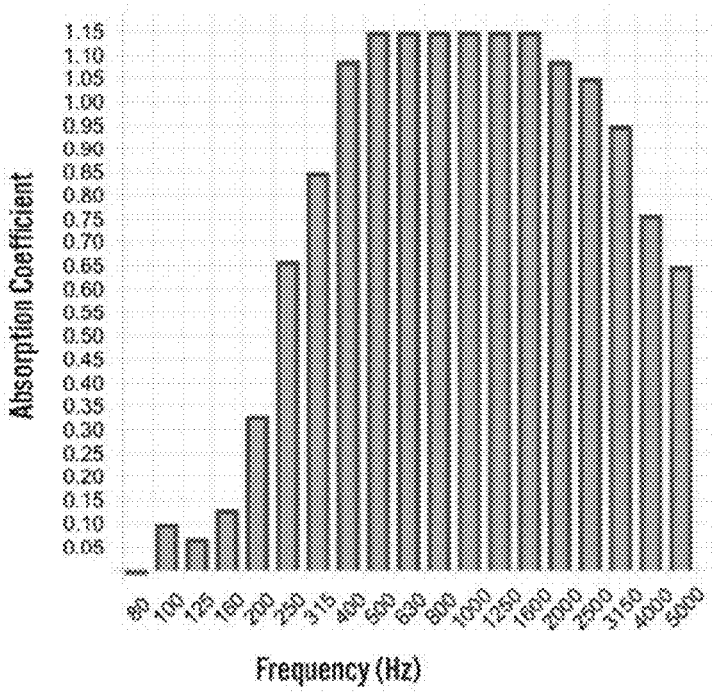
Figure 18:
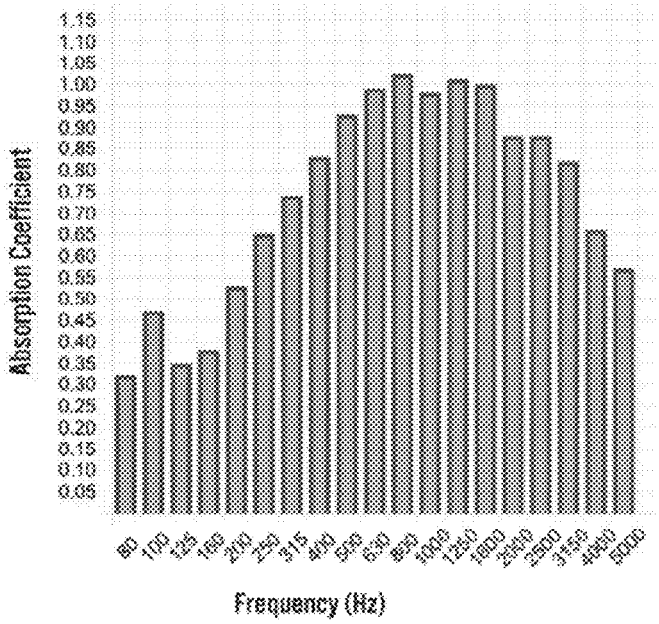
Figure 19:
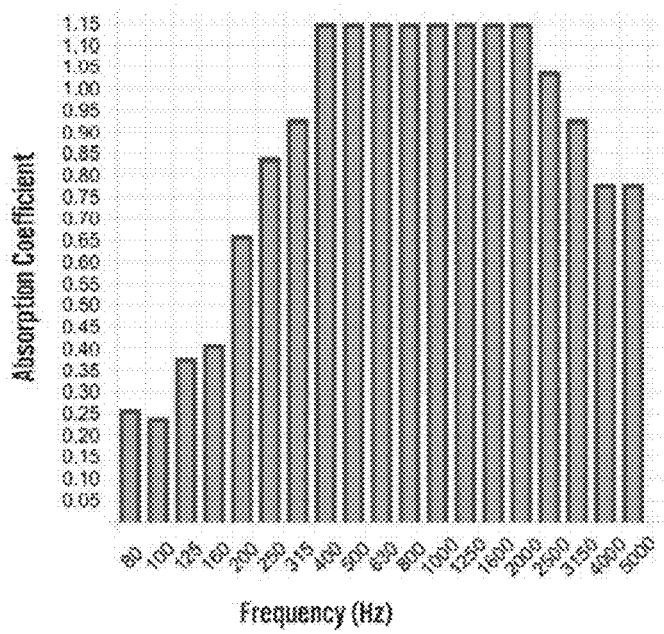
Figure 20:
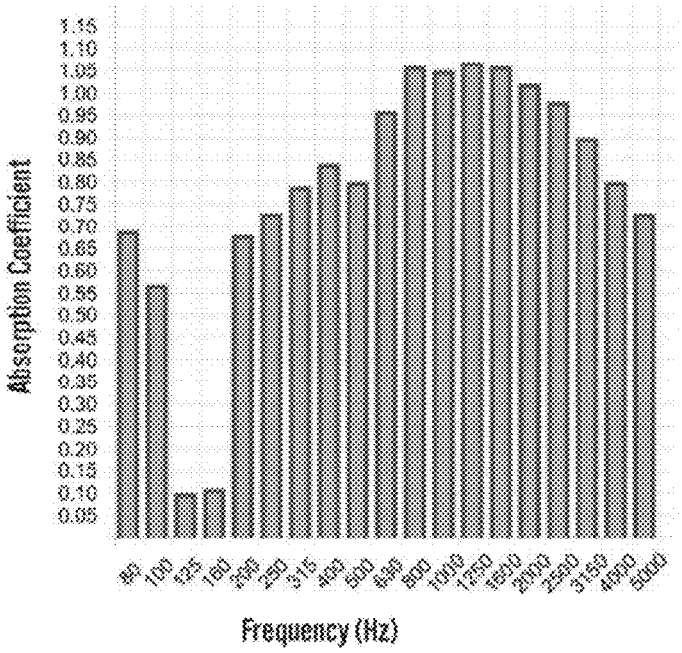
Figure 21:
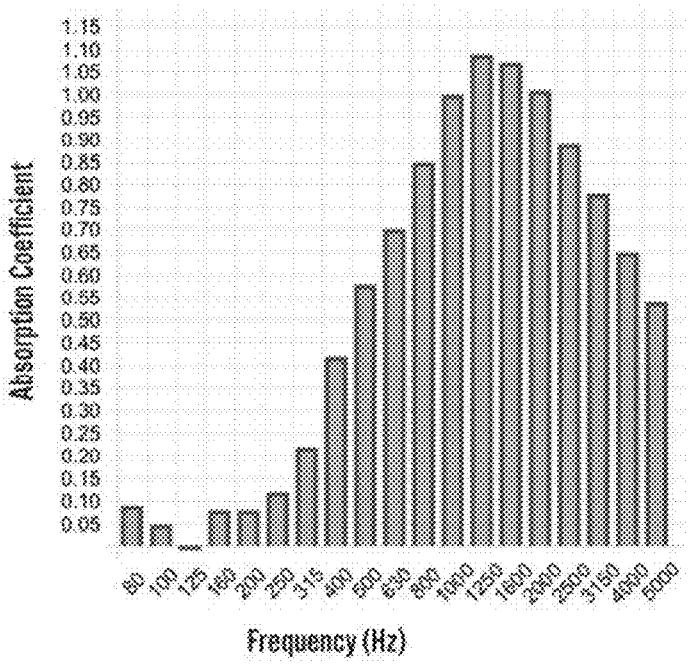
Figure 22:
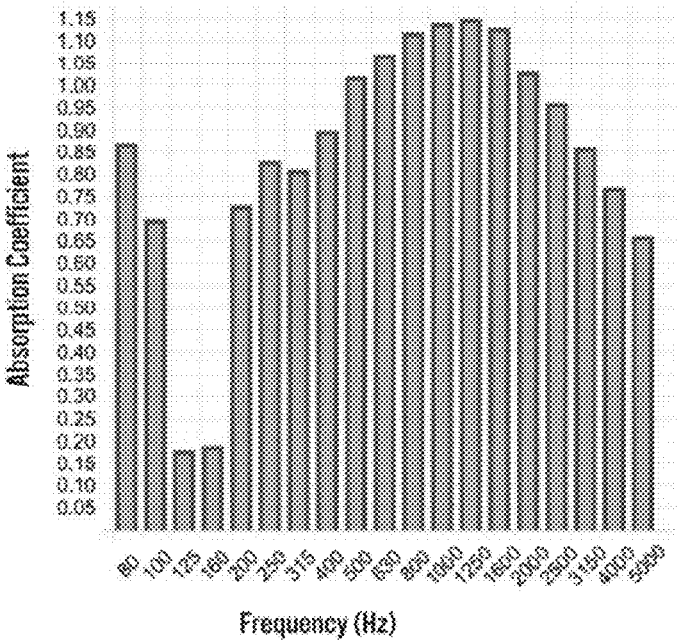
Figure 23:
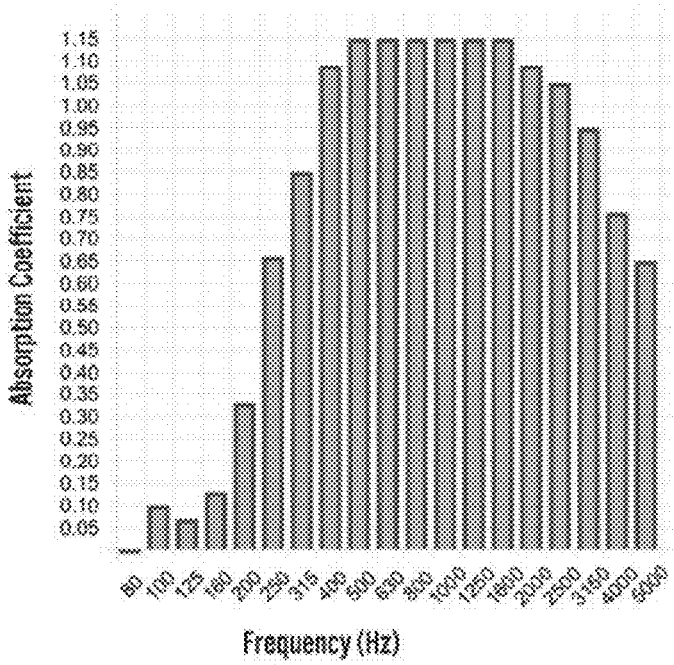
Figure 24:
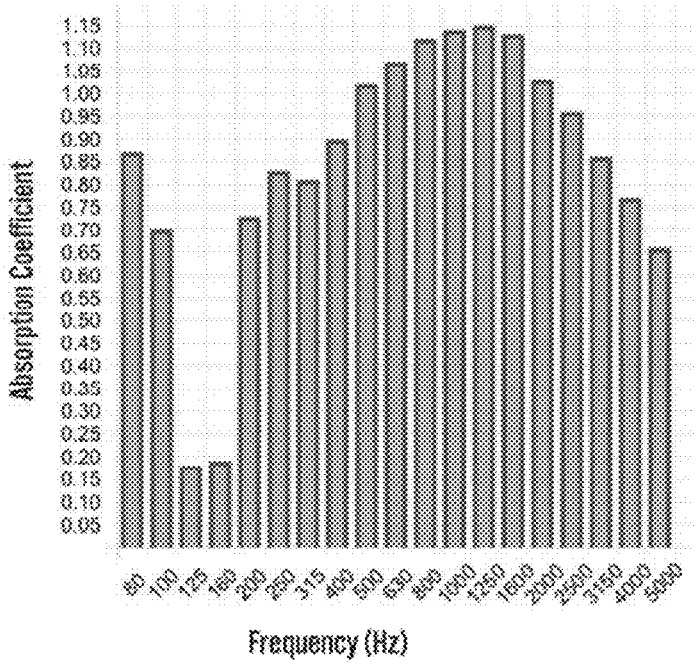
Figure 25:
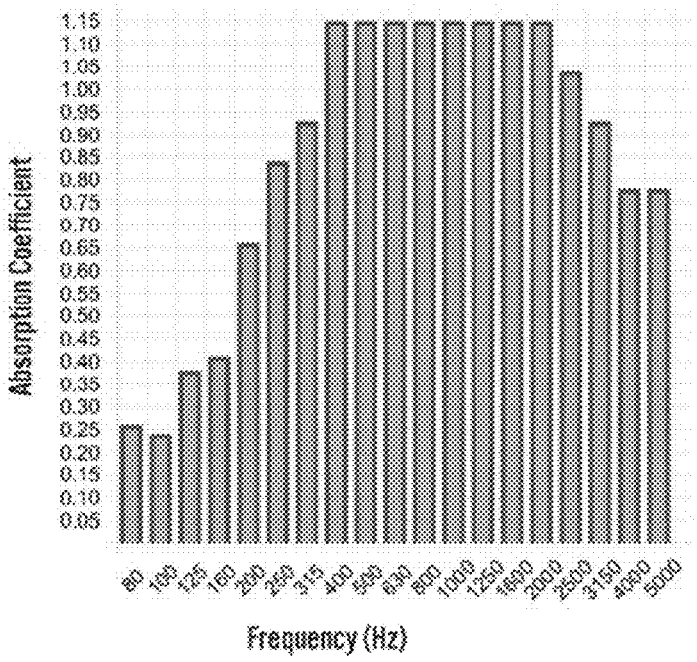
Figure 26:
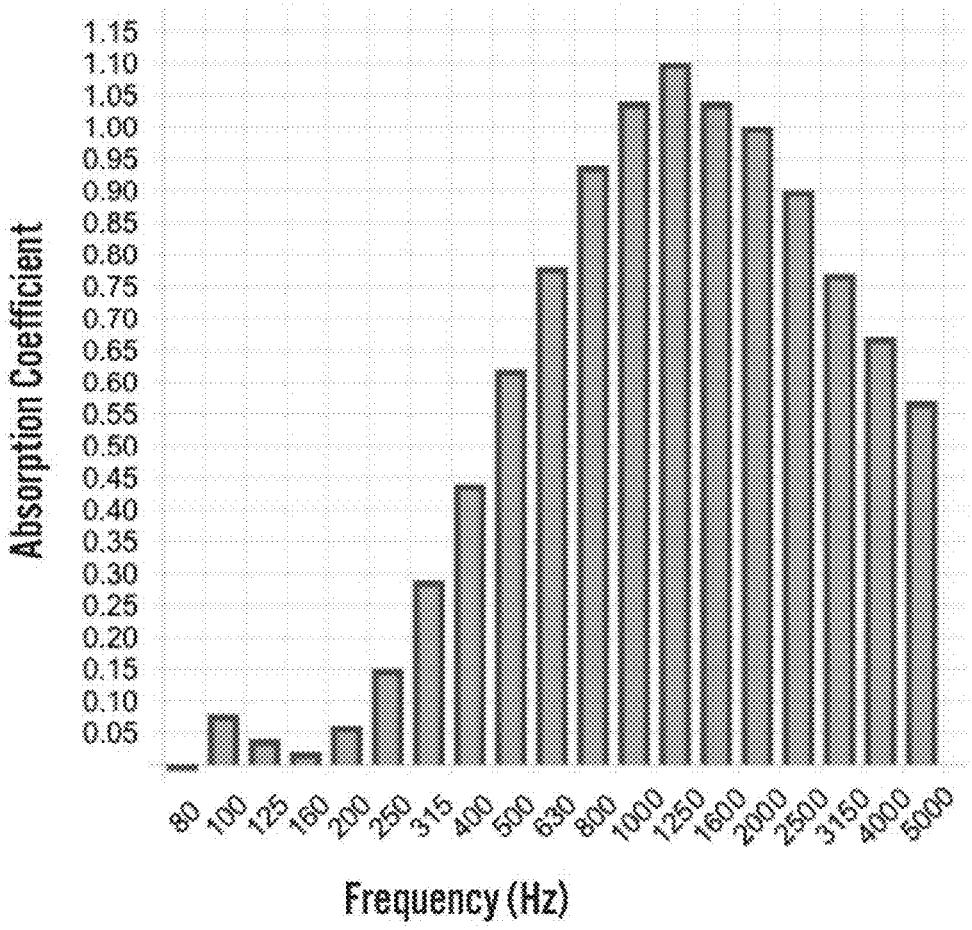
Figure 27:
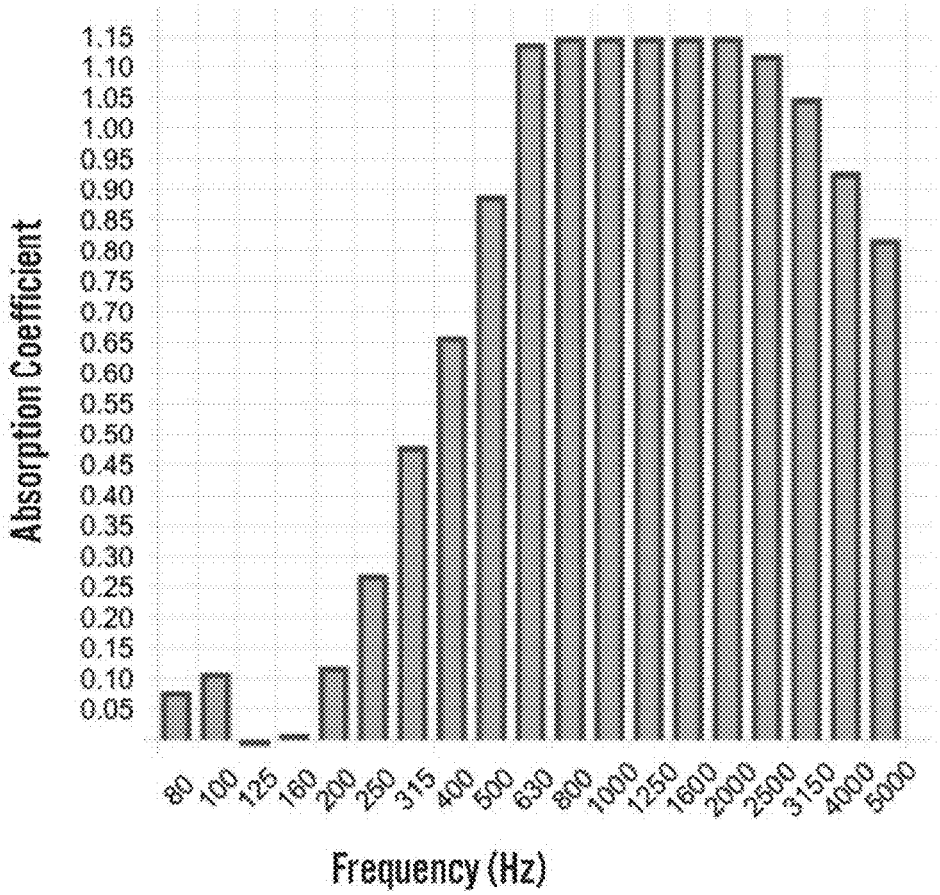

| Acoustic Performance and FIG. Numbers | | | | | |
|---|---|---|---|---|---|
| | Designation | | | | |
| | SC P-19 | RF P-19 | RF P-25 | RF M-19 | RF M-25 |
| NRC Range | .50-1.00 | .65-1.15 | .80-1.15 | .70 | .90 |
| Mounting | | | | Direct | Direct |
| E400 | .70 | .85 | .90 | | |
| E400 + 1 inch fiberglass | .95 | .90 | 1.00 | | |
| E400 + 2 inch fiberglass | 1.00 | .90 | 1.00 | | |
| F-6 | .50 | .70 | .80 | | |
| F-6 + 1 inch fiberglass | .90 | .95 | 1.05 | | |
| F-6 + 2 inch fiberglass | 1.00 | 1.00 | 1.15 | | |
| Mounting | | | | | |
| Direct | | | | FIG. 26 | FIG. 27 |
| E400 | FIG. 8 | FIG. 14 | FIG. 20 | | |
| E400 + 1 inch fiberglass | FIG. 10 | FIG. 16 | FIG. 22 | | |
| E400 + 2 inch fiberglass | FIG. 12 | FIG. 18 | FIG. 24 | | |
| F-6 | FIG. 9 | FIG. 15 | FIG. 21 | | |
| F-6 + 1 inch fiberglass | FIG. 11 | FIG. 17 | FIG. 23 | | |
| F-6 + 2 inch fiberglass | FIG. 13 | FIG. 19 | FIG. 25 | | |

Figure 28:
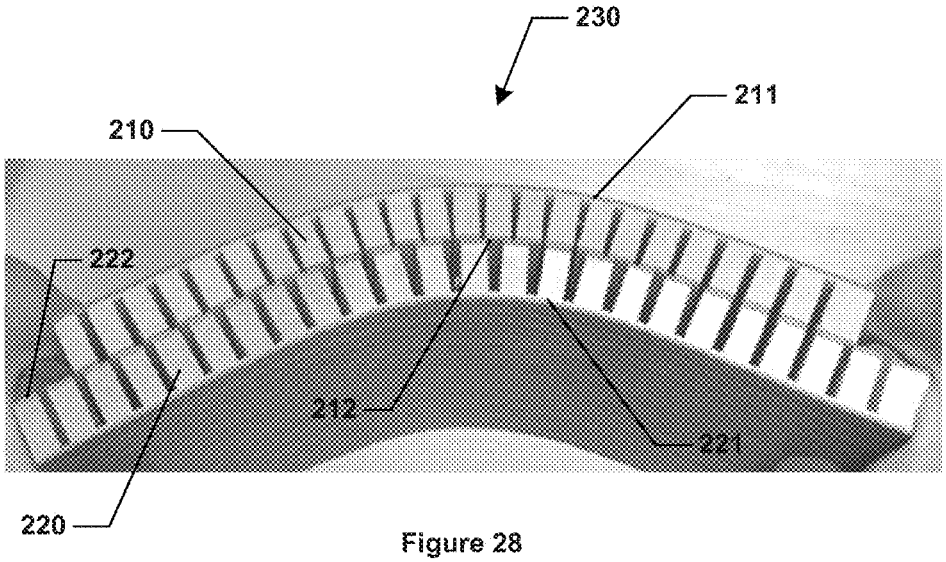
FIGS. 28-31 are perspective schematic views of an alternative embodiment.

FIGS. 28-31 are perspective schematic views of an alternative embodiment according to the principles described above, specifically examples of lightweight curved ceiling panel assemblies which may be installed without the use of heavy and costly structural supports. In general terms, such an assembly comprises at least one panel created as described above (FIG. 31, discussed later), although two such panels are constructed in the same manner may be used (FIG. 28, discussed next). Any such panel has a back face defining a series of kerfs, and an added backing layer providing flexible structure to the kerfed back face. When two kerfed panels are used, the two panels are adhered to each other, between each kerfed back face such that the kerfs face each other, and in that sense the entire second panel operates like a backing layer for the first.

As specifically illustrated in FIG. 28 (the double-panel configuration), the back of each of two panels 210, 220 is repeatedly slit or kerfed (e.g., with a saw blade or any other suitable tool) to within approximately ⅛" from the surfaces of their respective faces (211, 221), producing a series of slits or kerfs spaced ½"-1" apart. The slits or kerfs can expand or contract when the panel is flexed either convexly (panel 210) or concavely (panel 220) with respect to the uncut outer or front (microperforated) surface (211 and 221, respectively). In addition to enabling this change in shape, the slits or kerfs provide clearance that precludes undue compression of the acoustical absorption material and other internal structure of the panel. Such compression could, consistent with the principles discussed above, reduce the acoustic absorption performance of the assembly.

Thus, two such slitted panels are adhered to each other back-to-back at their internal faces (formerly their back faces) 212, 213 with an adhesive, and held in a non-planar configuration (e.g., a simple curve or a complex serpentine shape) until as the adhesive cures. For example, the panels may be placed in forms known to be suitable for this purpose, even if such forms need to be customized for a particular instance. Once the adhesive has cured and the form removed, the bonded panel 230 will hold the shape of the form.

Figure 31:
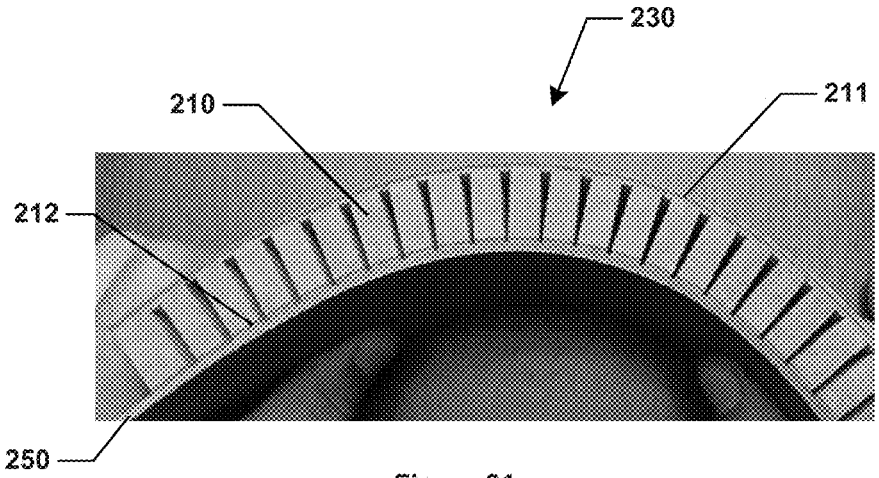
Figure 29:
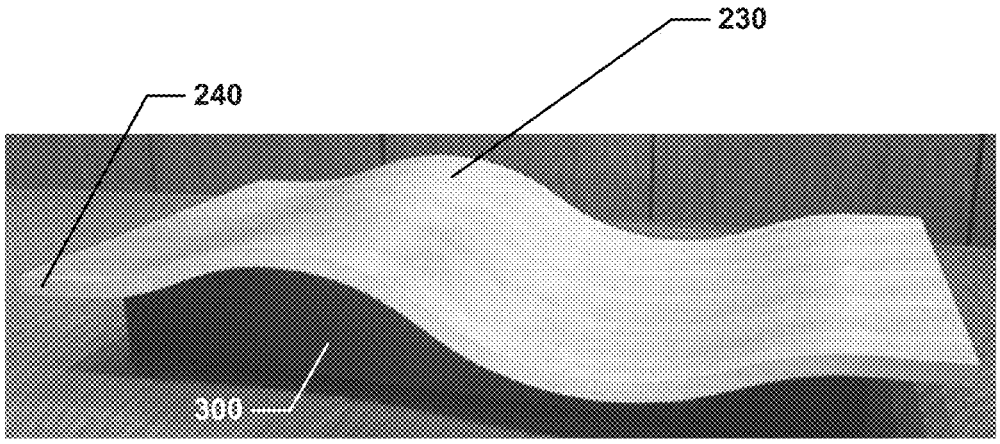

FIG. 31 illustrates a variation on this embodiment which is even more preferred than the variation illustrated in FIG. 28. Consider a bonded panel 230 of 1" desired thickness, although the desired thickness is just an example. Rather than producing two ½" sheets, then kerfing the backs of each and bonding them together as described above, another option is to make a single 1" sheet 210, kerf the back side 212, and laminate a thin flexible sheet of backing material 250 to the kerfed back side 212. This will allow the bonded panel 230 to still hold its desired shape, but requires less cost and effort to produce one sheet 210 instead of two. Thus, the backing material 250 in this single-panel embodiment serves the role of the face 221 of the second (back) panel 220 in the double-panel embodiment of FIG. 28.

In either case, the result is a thin, lightweight curved acoustical panel 230 having a decorative face on one or both sides (i.e., faces 211, and 221 or 250 if desired), and no visible support frame. Also, despite the removal of a major amount of acoustic absorbing material from either or both panels, the overall acoustic performance of the assembly is satisfactory in many applications.

Figure 30:
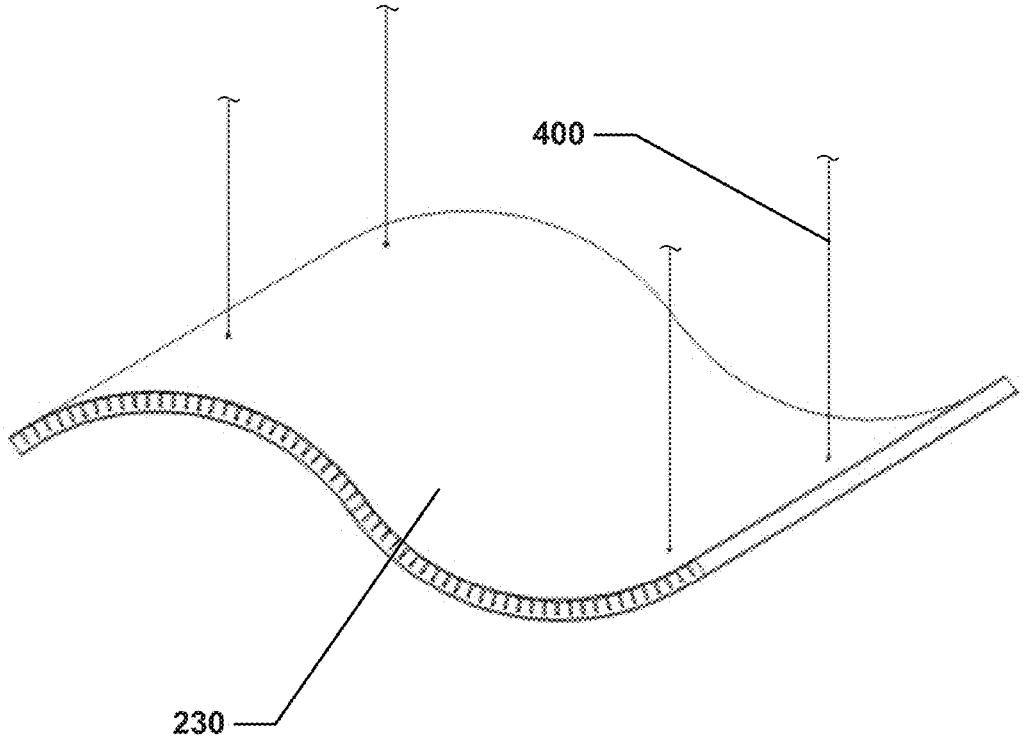

As specifically shown in FIG. 30, the panel 230 may be hung (as by one or more cables or rods 400 or the equivalent) from a ceiling or other structure (not shown for clarity), or otherwise supported or suspended "in air" without losing its serpentine shape. When such a panel is suspended overhead, it may be desirable to microperforate only the lower, ground-facing, panel and not the panel which will face upward, i.e., to use an embodiment more like that of FIG. 31 than FIG. 28.

However, for reasons of manufacturing efficiency or to capture ceiling-reflected sound, it is possible and desired to microperforate both panels. In any event, as shown specifically in FIG. 29, after the panel 230 is bonded together and cut to exact dimensions, a matching surface 240 can be applied to the edge to cover the exposed substrate. (The panel illustrated in FIG. 29 lies on a support platform 300 that forms no part of the panel or the installation system.) This allows the panel 230 to not only be decorative, and highly acoustically absorbent, but also act as an acoustical diffuser for use in performing arts centers and theaters.

We claim:

1. An acoustical panel for absorbing sound from a source, comprising:

a. a surface layer defining within itself a plurality of microperforations characterized by average diameters in a range of 0.3 to 0.9 millimeter;

b. an acoustical absorbing layer, on an opposite side of the surface layer from the source of sound, comprising a combination of a support matrix defining a plurality of cells and fiberglass having at least six pounds per cubic foot filling each cell, in which the fiberglass comprises individual sheets of fibers; and c. a back layer on an opposite side of the acoustical absorbing layer from the surface layer;

in which each of the surface layer and the back layer comprises respective outer and inner surfaces, and individual sheets of fiberglass run between the inner surface of the surface layer and the inner surface of the back layer along the direction corresponding to panel thickness.

2. The acoustical panel of claim 1, in which the surface layer comprises a decorative wood veneer and a substrate having inner and outer surfaces, in which the veneer is laminated to the outer surface of the substrate and the acoustical absorbing layer is adjacent the inner surface of the substrate.

3. The acoustical panel of claim 1, in which the fiberglass has a density of less than 16 pounds per cubic foot.

4. The acoustical panel of claim 1, in which the fiberglass has a density of twelve pounds per cubic foot and a thickness of about one inch.

5. The acoustical panel of claim 1, in which the back layer is perforated.

6. The acoustical panel of claim 1, in which the support matrix comprises stacked layers of vertically oriented long strand resin-bonded fiberglass mesh.

7. The acoustical panel of claim 6, in which the fiberglass mesh has thickness of 0.25 to 1.0 mm.

8. The acoustical panel of claim 7, in which the fiberglass mesh has thickness of 0.5 mm.

9. The acoustical panel of claim 1, in which the fiberglass substantially completely fills each cell of the acoustical absorbing layer.

10. An assembly comprising at least one panel for absorbing sound from a source, the panel comprising:

i. a surface layer defining within itself a plurality of microperforations characterized by average diameters in a range of 0.3 to 0.9 millimeter;

ii. an acoustical absorbing layer, on an opposite side of the surface layer from the source of sound, comprising a combination of a support matrix defining a plurality of cells and fiberglass having at least six pounds per cubic foot filling each cell, in which the fiberglass comprises individual sheets of fibers; and iii. a back layer on an opposite side of the acoustical absorbing layer from the surface layer;

in which each of the surface layer and the back layer comprises respective outer and inner surfaces, and individual sheets of fiberglass run between the inner surface of the surface layer and the inner surface of the back layer along the direction corresponding to panel thickness; and in which the panel has a back face defining a series of kerfs, and the assembly further comprises a backing layer providing flexible structure to the kerfed back face.

11. The assembly of claim 10, in which the assembly comprises two kerfed panels, one of which kerfed panels comprises a surface layer forming the backing layer.

12. The assembly of claim 10, in which the assembly is in a non-planar configuration.

13. The assembly of claim 10, in which the surface layer comprises a decorative wood veneer and a substrate having inner and outer surfaces, in which the veneer is laminated to the outer surface of the substrate and the acoustical absorbing layer is adjacent the inner surface of the substrate.

14. The assembly of claim 10, in which the fiberglass has a density of less than 16 pounds per cubic foot.

15. The assembly of claim 10, in which the fiberglass has a density of twelve pounds per cubic foot and a thickness of about one inch.

16. The assembly of claim 10, in which the support matrix comprises stacked layers of vertically oriented long strand resin-bonded fiberglass mesh.

17. The assembly of claim 16, in which the fiberglass mesh has thickness of 0.25 to 1.0 mm.

18. The assembly of claim 17, in which the fiberglass mesh has thickness of 0.5 mm.

19. The assembly of claim 10, in which the fiberglass substantially completely fills each cell of the acoustical absorbing layer.

* * * * *